US008784611B2

(12) United States Patent
Juppo et al.

(10) Patent No.: US 8,784,611 B2
(45) Date of Patent: Jul. 22, 2014

(54) PROCESS FOR PRODUCTION OF PAPER

(75) Inventors: Ari Juppo, Vaasa (FI); Ulf Stenbacka, Vaasa (FI)

(73) Assignee: Kemira OYJ, Helsinki (FI)

( * ) Notice: Subject to any disclaimer, the term of this patent is extended or adjusted under 35 U.S.C. 154(b) by 0 days.

(21) Appl. No.: 13/501,653

(22) PCT Filed: Nov. 3, 2010

(86) PCT No.: PCT/FI2010/050887

§ 371 (c)(1), (2), (4) Date: May 25, 2012

(87) PCT Pub. No.: WO2011/055017

PCT Pub. Date: May 12, 2011

(65) Prior Publication Data

US 2012/0227920 A1 Sep. 13, 2012

Related U.S. Application Data

(60) Provisional application No. 61/257,905, filed on Nov. 4, 2009.

(30) Foreign Application Priority Data

Nov. 4, 2009 (EP) ..... 09174967

(51) Int. Cl.

| | |
|---|---|
| ***D21H 17/25*** | (2006.01) |
| ***D21H 17/44*** | (2006.01) |
| ***D21H 21/10*** | (2006.01) |
| *D21H 17/37* | (2006.01) |
| *D21H 21/52* | (2006.01) |

(52) U.S. Cl.

CPC ..... *D21H 21/10* (2013.01); *D21H 17/44* (2013.01); *D21H 17/37* (2013.01); *D21H 17/25* (2013.01); *D21H 17/375* (2013.01); *D21H 21/52* (2013.01); *Y10S 977/963* (2013.01)

USPC ..... 162/157.6; 162/168.2; 162/168.3; 977/963

(58) Field of Classification Search

CPC ..... D21H 11/16; D21H 11/18; D21H 11/20; D21H 11/22; D21H 21/10; D21H 21/50; D21H 21/52; D21H 21/24; D21H 17/44; D21H 17/45; D21H 17/37; D21H 17/375; D21H 17/25

USPC ..... 162/146, 157.6, 157.7, 168.1, 168.2, 162/168.3, 182, 185, 187, 183, 175–177; 977/762, 788, 895, 896, 961, 963

See application file for complete search history.

(56) References Cited

U.S. PATENT DOCUMENTS

| | | | | |
|---|---|---|---|---|
| 5,964,983 | A | 10/1999 | Dinand et al. | |
| 6,103,790 | A | 8/2000 | Cavaille et al. | |
| 6,602,994 | B1 * | 8/2003 | Cash et al. | 536/30 |
| 2004/0140074 | A1 * | 7/2004 | Tokarz et al. | 162/181.8 |
| 2011/0088860 | A1 * | 4/2011 | Heijnesson-Hulten et al. | 162/164.1 |
| 2012/0132383 | A1 * | 5/2012 | Laine et al. | 162/175 |

FOREIGN PATENT DOCUMENTS

| | | | |
|---|---|---|---|
| CN | 1335856 | A | 2/2002 |
| WO | 0047628 | A2 | 8/2000 |
| WO | WO0047628 | | 8/2000 |
| WO | 0106600 | A1 | 9/2001 |
| WO | WO0166600 | | 9/2001 |
| WO | WO03/000985 | | 1/2003 |
| WO | 2006127050 | A1 | 11/2006 |
| WO | WO2007/001229 | | 1/2007 |
| WO | WO 2007/001229 | * | 1/2007 |
| WO | 2007091942 | A1 | 8/2007 |
| WO | 2009123560 | A1 | 10/2009 |

OTHER PUBLICATIONS

The International Search Report and Written Opinion dated Feb. 17, 2011.

Wagberg, et al., "The Build-Up of Polyelectrolyte Multilayers of Microfibrillated Cellulose and Cationic Polyelectrolytes," Langmuir 2008, 24, pp. 784-795.

Paakko, et al., "Enzymatic Hydrolysis Combined with Mechanical Shearing and High-Pressure Homogenization for Nanoscale Cellulose Fibrils and Strong Gels," Biomacromolecules 2007, 8, pp. 1934-1941.

European Search Report dated Apr. 15, 2010.

Notification of the First Office Action; State Intellectual Property Office of the People's Republic of China; Application 201080049937.8; dated Jan. 6, 2014, 10 pages.

"Water-Soluble Acrylamide Polymers"; V.F. Kurenkov; Kypekob B.O; 6 pages; 1997.

* cited by examiner

*Primary Examiner* — Eric Hug

(74) *Attorney, Agent, or Firm* — Thomas Horstemeyer, LLP

(57) ABSTRACT

The invention relates to a process for the production of paper or board comprising: adding a retention system to a stream of stock entering a paper machine head box, directing the stream of stock to a wire, de watering the stream of stock on the wire to form a paper web, and drying the paper web, wherein the retention system comprises a water-soluble cationic polymer, and nanocellulose acting like a micro particle, wherein the nanocellulose is added in an amount of less than 1% as active substance based on dry solids weight of the stock.

25 Claims, No Drawings

PROCESS FOR PRODUCTION OF PAPER

CROSS REFERENCE TO RELATED APPLICATION

This application is the 35 U.S.C. §371 national stage of PCT application entitled "Process for Production of Paper," having serial number PCT/FI2010/050887, filed on 3 Nov. 2010, which claims priority to European Patent Application No. 09174967.1, filing date 4 Nov. 2009 and also claims priority to U.S. Provisional Application No. 61/257,905, filing date 4 Nov. 2009, each being incorporated by reference in their entirety.

FIELD OF THE INVENTION

The present invention relates to a process for the production of paper and board, wherein there is used as a retention system a cationic polymer and a microparticle-like substance nanocellulose.

BACKGROUND OF THE INVENTION

At present, the use of inorganic microparticles in the retention system of paper production, in particular in the production of fine paper, is very common, the aim being to improve further the efficiency of the production process. The advantages of the introduction of microparticles include improved retention, more efficient dewatering, and better formation. The most effective of the microparticles in use are colloidal silica-based microparticles of various types, solid or sol, and bentonite-like swellable natural materials belonging to the smectite group of clays. Instead of, or in addition to, a microparticulate compound it is possible to use as a retention aid in the retention system polymers, which may be anionic, cationic or non-ionic, and which are characterized by a high molecular weight. The problem involved with these compounds is typically excessive flocculation, which deteriorates the optical properties of paper.

Bentonite has been used as a retention aid in paper production together with a cationic polymer in the U.S. Pat. No. 4,753,710. In the process according to this patent, a cationic polymer, preferably polyethylene imine, a polyamine epichlorohydrin product, a polymer of diallyl dimethyl ammonium chloride, or a polymer of acrylic monomers, was added to an aqueous cellulosic suspension before the last shearing stage, and bentonite was added after this shearing stage. Improved retention, dewatering, drying, and web forming properties were thereby achieved. In the microparticle system according to this process there is used bentonite, which is available under the trade name HYDROCOL.

The use of silicate microparticles together with a cationic polymer in a retention system is described in the U.S. Pat. No. 5,194,120. The prevalent cation in the synthetic amorphous metal silicate was Mg, and the polymer was preferably a ternary or quaternary amine derivative of polyacrylamide, their weight ratio being between 0.03:1 and 30:1. By this method, retention, dewatering and formation were improved by using smaller amounts of retention aids than previously, and thus the costs were correspondingly lower.

WO 01/40577 A1 discloses a method for the production of paper or board, wherein retention aids are added to the stream of stock. Improved retention and more effective dewatering are achieved by adding to the stream of stock a cationic polymer solution and a suspension-form microparticle mixture composed of a swellable clay of the smectite group, such as bentonite, and a colloidal synthetic metal silicate in which the prevalent cation is magnesium.

The most commonly used microparticles are inorganic materials, especially various minerals. Such minerals increase the ash content of the produced paper.

U.S. Pat. No. 4,483,743 discloses a process for manufacturing microfibrillated cellulose (MFC) by passing a liquid suspension of cellulose through a high pressure homogenizer having a small diameter orifice in which the suspension is subjected to a pressure drop of at least 3000 psig (20670 kPa) and a high velocity shearing action followed by a high velocity decelerating impact, and repeating the passage of said suspension through the orifice until the cellulose suspension becomes substantially stable. The produced MFC has a water retention value of over 280%. The MFC can be used with paper products and non-woven sheets to improve their strength. MFC produced by this type of process typically has a width of about 25-100 nm while the length is much longer.

U.S. Pat. No. 4,952,278 discloses a paper structure having both high opacity and improved tensile strength obtained by the incorporation of expanded cellulosic fibers and an opacifying mineral pigment, such as titanium dioxide. The expanded cellulosic fiber may be microfibrillated cellulose described in the above patent. The expanded cellulosic fibers are added in an amount of from 1% to 25%, preferably from 5% to 10% based on the dry weight of the opacified paper structure.

WO 2007/091942 A1 discloses an improved method for manufacturing microfibrillated cellulose. The disclosed method is said to solve the problems relating to clogging in high-pressure homogenizers and high energy consumption. According to this document microfibrillated cellulose is manufactured by refining a hemicelluloses containing pulp, preferably sulphite pulp, and treating the pulp with a wood degrading enzyme followed by homogenizing the pulp. The enzyme is a cellulase, preferably a cellulase of endoglucanase type which most preferably is a mono-component endoglucanase. The pulp can be refined before or after the enzyme treatment or both before and after the enzyme treatment. The obtained microfibrillated cellulose can be used in food products, cosmetic products, pharmaceutical products, paper products, composite materials, coatings or in rheology modifiers (e.g. drilling muds).

Yet another type of microfibrillated cellulose is described by Wågberg Lars et al., Langmuir 2008, Vol. 24, 2008, pages 784-795. This microfibrilled cellulose was prepared by high-pressure homogenization of carboxymethylated cellulose fibers. The fibers were sulfite softwood-dissolving pulp fibers. The produced MFC typically has a width of about 5-15 nm and a length which can be more than 1 μm.

Also other chemical pretreatment methods are known, such as an oxidation pretreatment of pulp fibers described by Saito et al. in Biomacromolecules, Vol. 8, No. 8, 2007, pp. 2485-2491. The pulp fibers are oxidized with a 2,2,6,6-tetramethylpiperidine-1-oxyl radical (TEMPO)-mediated system followed by mechanical treatment. This oxidation pretreatment converts primary hydroxyl groups of the celluloses to carboxylate groups. The produced nanofibers typically have a width of about 3-4 nm and a length of a few μm.

One of the purposes of the present invention is to provide an organic substance which acts like a microparticle, which results in an improved retention as compared to mineral microparticles and which is made of a renewable material.

SUMMARY OF THE INVENTION

According to the present invention it has been found that nanocellulose can be used as a microparticle-like substance in a retention system together with a water-soluble cationic polymer for improving total retention and filler retention during the production of paper or board. Additionally it was found that besides improving the retention, the nanocellulose also improved drainage of papermaking stock in the production of paper or board.

According to our observations, when nanocellulose is used together with cationic polyacrylamide, it serves as an effective microparticle-like substance in the retention system. Compared with this, a retention system comprising cationic polyacrylamide and as an inorganic microparticle bentonite is not as effective.

DETAILED DESCRIPTION OF THE INVENTION

Thus, according to a first aspect of the present invention there is provided a process for the production of paper or board comprising:

adding a retention system to a stream of stock entering a paper machine headbox, directing the stream of stock to a wire, dewatering the stream of stock on the wire to form a paper web, and drying the paper web, wherein the retention system comprises a water-soluble cationic polymer, and nanocellulose acting like a microparticle, wherein the nanocellulose is added in an amount of less than 1% as active substance based on dry solids weight of the stock.

The nanocellulose is preferably added in an amount of between 0.02 and 0.8%, more preferably between 0.05 and 0.7%, and most preferably between 0.1 and 0.5% as active substance based on dry solids weight of the stock.

The nanocellulose may be added in the form of an aqueous suspension or gel comprising at most 5%, preferably 0.1 to 4%, more preferably from 0.3 to 3% by weight solids.

The term nanocellulose as used in this specification includes microfibrillated/microfibrillar cellulose and nanofibrillated/nanofibrillar cellulose of the types described e.g. in the above discussed publications. The basic idea underlying the development of nanocellulose was to simply delaminate the cell wall and liberate the microfibrils, which constitute the major building block of wood fibers. The nanocelluloses are gel type of materials even at very low concentrations. The width and length of the nanocellulose fibers vary depending on the specific manufacturing process. A typical width of nanocellulose is from about 3 to about 100 nm, preferably from about 10 to about 30 nm, and a typical length is from about 100 nm to about 2 μm, preferably from about 100 to 1000 nm.

The nanocellulose can be produced from cellulosic pulp or prehydrolyzed cellulosic pulp including sulphite pulp and kraft pulp by multiple shearing as described in U.S. Pat. No. 4,483,743, or by enzymatic hydrolysis combined with mechanical shearing as described in WO 2007/091942, or by chemically pretreating/modifying the cellulosic pulp and then subjecting the same to mechanical shearing as described by Wågberg Lars et al., Langmuir 2008, Vol. 24, pages 784-795, and Saito et al., Biomacromolecules, Vol. 8, No. 8, 2007, pp. 2485-2491.

As explained above there are various types of nanocellulose depending on the manufacturing process. A preferred nanocellulose is of the type produced from cellulose pulp by enzymatic treatment followed by homogenization in a high-pressure homogenizer. The enzyme in the enzymatic treatment preferably comprises a cellulase, such as endoglucanase. The high-pressure homogenizer preferably comprises z-shaped chambers and the pulp is passes several times, preferably at least three times through the chambers.

Another preferred nanocellulose is of the type produced from cellulose pulp by chemical pre-treatment followed by homogenization in a high-pressure fluidizer/homogenizer. Various chemical modifications are known in the art. A preferred chemical pre-treatment comprises carboxymethylation of the cellulose fibers. The pulp may be sulphite pulp or kraft pulp. Also dissolving pulps, such as sulphite dissolving pulp, having a low content of hemicellulose may be used. The high-pressure homogenizer preferably comprises z-shaped chambers and the pulp is passes at least once through the chambers.

Suitable pulps that may be used for the production of nanocellulose include all types of chemical wood-based pulps, such as bleached, half-bleached and unbleached sulphite, sulphate and soda pulps. Also dissolving pulps having a low content, typically below 5%, of hemicelluloses can be used.

The components of the retention system can be added simultaneously or sequentially.

According to a preferred embodiment the components of the retention system are added sequentially.

Preferably the sequential addition comprises adding the water-soluble cationic polymer to form flocs, followed by subjecting the stock to shearing forces to break up the flocs, and then adding the nanocellulose. The time between the addition of the water-soluble cationic polymer and the nanocellulose is preferably at most 60 seconds, more preferably between 0.5 and 20 seconds.

The cationic polymer used in the invention can be produced advantageously by copolymerizing acrylamide with a cationic monomer or methacrylamide with a cationic monomer. The molecular weight of the cationic polymer is preferably at least 500,000, and it is added to the stock preferably in an amount of at minimum 0.02%, especially preferably 0.03-0.05% as active substance based on dry solids weight of the stock.

The cationic polymer used in the invention may be any copolymer of acrylamide and/or methacrylamide, prepared using at least as one of the comonomers a cationically charged or cationically chargeable monomer. Such monomers include methacryloyloxyethyltrimethyl ammonium chloride, acryloyloxyethyltrimethyl ammonium chloride, 3-(methacrylamido)propyltrimethyl ammonium chloride, 3-(acryloylamido)propyltrimethyl ammonium chloride, diallyldimethyl ammonium chloride, dimethylaminoethyl acrylate, dimethylaminoethyl methacrylate, dimethylaminopropylacrylamide, dimethylaminopropylmethacrylamide, or a similar monomer. The polymer may also contain monomers other than acrylamide, methacrylamide, or some cationic or cationizable monomer.

The cationic polymer may also be a polymer which has been treated afterwards to render it cationic, for example, a polymer prepared from polyacrylamide or polymethacrylamide by using Hofmann or Mannich reactions.

The cationic polymer may be prepared by conventional radical-initiation polymerization methods, and as a product it may be either dry powder or an emulsion of a polymer solution in an organic medium.

Before dosing, preferably a 0.05-0.5% solution, especially preferably a 0.1-0.3% solution, is prepared of the polymer, which solution may be further diluted before the feeding point in order to ensure good mixing.

The method according to the invention was observed to be robust with respect to various test arrangements, pulps, and fillers. The stock material and its initial pulp may, for example, comprise a conventional chemical pulp (cellulose), chemimechanical pulp or mechanical pulp or other conventional raw materials used in paper making, such as recycled fiber. The filler, which may be, for example, ground or precipitated calcium carbonate, kaolin, calcined kaolin, talc, titanium dioxide, gypsum, synthetic inorganic or organic filler, preferably, however, calcium carbonate, is incorporated into the pulp by a conventional method before the adding of the cationic polymer. Additionally, additives commonly used in the production of paper may be introduced into the stock. The process according to the invention can be used in any conventional paper- or board-making apparatus.

In a second aspect, the present invention relates to the use of nanocellulose as a material acting like a microparticle for improving the retention of papermaking raw materials during the production of paper or board, wherein the nanocellulose is used in an amount of less than 1% as active substance based on dry solids weight of the papermaking stock. At the same time also the drainage of papermaking stock in the production of paper or board will be improved.

The nanocellulose is preferably used in an amount of between 0.02 and 0.8%, more preferably between 0.05 and 0.7%, and most preferably between 0.1 and 0.5% as active substance based on dry solids weight of the stock.

The nanocellulose is preferably used together with a retention aid comprising a water-soluble cationic polymer as defined above.

It is preferred to use the nanocellulose sequentially with the cationic polymer, preferably in such as manner that the nanocellulose is added after the cationic polymer. However, it is also possible to use the nanocellulose and the cationic polymer simultaneously.

By the use of the nanocellulose microparticle according to the present invention, a surprisingly good retention is achieved. When the nanocellulose microparticle-like, organic substance of the present invention is used as a retention aid, the ash (filler) retention may be from 5 up to 15 percent units higher as compared to bentonite at the same dosage levels. Good filler retention is especially important because the filler constitutes the main part of the stock fraction that is difficult to retain on the wire.

By the process of the present invention, retention can be improved further as compared to prior known processes and, at the same time, if so desired, the amount of the required retention aid can be reduced, and furthermore the total ash load can be lowered as compared to prior known processes using minerals.

The invention and its preferred embodiments are described below with the help of various examples; the purpose of the examples is, however, not to restrict the scope of the invention. In this specification percentage refers to percentage by weight unless otherwise specified.

EXAMPLES

Example 1

Retention tests were carried out using a Dynamic Drainage Jar (DDJ) apparatus. The stock used was stock taken from a fine-paper machine. The stock sample had been taken from the machine chest. The filler was added to the stock and the content of the filler in the stock was 45% of the dry solids content of the stock. The filler was precipitated calcium carbonate. For the tests the stock was diluted with white water to a consistency of 8.0 g/l. Starch was added into the stock before the retention test started. The following, stepwise procedure was used in the tests:

1. At time 0 s, the mixing velocity being 1500 rpm, the stock sample was poured into a vessel.
2. At 15 s, the polymer was dosed into the stock.
3. At 30 s, the microparticle or microparticle-like substance was dosed into the stock.
4. At 45 s, a filtrate sample was taken.

The wire used was a 200-mesh DDJ wire 125P. The polymer was a Kemira cationic polyacrylamide (PAM), which is a copolymer of acrylamide and acryloyloxyethyltrimethyl ammonium chloride and has a charge of approx. 1 meq/g and a molecular weight of approx. 7 Mg/mol. The bentonite microparticle used was Altonit SF of Kemira. The other component acting like a microparticle was a nanocellulose produced by high-pressure homogenization of carboxymethylated cellulose fibers in a homogenizer. The nanocellulose was diluted from 2% to 0.5% in the same homogenizer. The dosages are indicated as the amount of the material dosed as active substance per dry solids weight of the stock, the unit being g/tonne. The retention results are shown in Table 1 and 2.

TABLE 1

First pass retention (%) with DDJ.

| | without microparticle | Bentonite dosage 1 | Bentonite dosage 2 | Bentonite dosage 3 | Nanocel. dosage 1 | Nanocel. dosage 2 | Nanocel. dosage 3 |
|---|---|---|---|---|---|---|---|
| 0-test | 63.0 | 63.0 | 63.0 | 63.0 | 63.0 | 63.0 | 63.0 |
| PAM dosage 1 | 70.2 | 72.1 | 74.4 | 78.2 | 73.3 | 80.2 | 83.2 |
| PAM dosage 2 | 71.3 | 74.0 | 77.1 | 81.1 | 76.7 | 84.2 | 88.4 |

TABLE 2

First pass ash retention (%) measured with DDJ.

| | without microparticle | Bentonite dosage 1 | Bentonite dosage 2 | Bentonite dosage 3 | Nanocel. dosage 1 | Nanocel. dosage 2 | Nanocel. dosage 3 |
|---|---|---|---|---|---|---|---|
| 0-test | 11.4 | 11.4 | 11.4 | 11.4 | 11.4 | 11.4 | 11.4 |
| PAM dosage 1 | 22.1 | 33.4 | 40.5 | 48.2 | 37.2 | 51.9 | 59.3 |
| PAM dosage 2 | 32.9 | 38.4 | 45.5 | 55.8 | 43.8 | 62.6 | 71.4 |

PAM dosage 1 = 300 g/tonne
PAM dosage 2 = 600 g/tonne
Bentonite dosage 1 = 500 g/tonne
Bentonite dosage 2 = 1500 g/tonne
Bentonite dosage 3 = 3000 g/tonne
Nanocel. dosage 1 = 500 g/tonne
Nanocel. dosage 2 = 1500 g/tonne
Nanocel. dosage 3 = 3000 g/tonne With all PAM dosages it can be observed that the nanocellulose microparticle-like material works with the same dosages better than bentonite.

This example shows clearly that the retention results with nanocellulose acting like a microparticle are essentially better than when bentonite is used.

Example 2

Drainage tests were carried out using a Dynamic Filtration System (DFS-03) apparatus. The stock used was stock taken from a fine-paper machine. The stock sample had been taken from the machine chest. The filler was added to the stock and the content of the filler in the stock was 45% of the dry solids content of the stock. The filler was precipitated calcium carbonate. For the tests the stock was diluted with white water to a consistency of 8.0 g/l. Starch was added into the stock before the drainage test started. The following, stepwise procedure was used in the tests:

1. At time 0 s, the mixing velocity being 800 rpm, the stock sample was poured into a vessel.
2. At 15 s, the polymer was dosed into the stock.
3. At 30 s, the microparticle or microparticle-like substance was dosage into the stock.
4. At 45 s, dewatering was started and the measured for 60 s.

The wire used was a 60-mesh DFS wire. The polymer was a Kemira cationic polyacrylamide (PAM), which is a copolymer of acrylamide and acryloyloxyethyltrimethyl ammonium chloride and has a charge of approx. 1 meq/g and a molecular weight of approx. 7 Mg/mol. The bentonite microparticle used was Altonit SF of Kemira. The other component acting like a microparticle was the same nanocellulose as in example 1. The dosages are indicated as the amount of the material dosed as active substance per dry solids weight of the stock, the unit being g/tonne. The drainage results are shown in Table 3.

TABLE 3

| | Dewatering time (in seconds) for 700 ml filtrate measured with DFS-03, | | | | | |
|---|---|---|---|---|---|---|
| | Bentonite dosage 1 | Bentonite dosage 2 | Bentonite dosage 3 | Nanocel. dosage 1 | Nanocel. dosage 2 | Nanocel. dosage 3 |
| 0-test | 47.5 | 47.5 | 47.5 | 47.5 | 47.5 | 47.5 |
| Polymer dosage | 42.5 | 35.9 | 34.8 | 40.5 | 35.3 | 25.5 |

Polymer dosage = 600 g/tonne
Bentonite dosage 1 = 500 g/tonne
Bentonite dosage 2 = 1500 g/tonne
Bentonite dosage 3 = 3000 g/tonne
Nanocel. dosage 1 = 500 g/tonne
Nanocel. dosage 2 = 1500 g/tonne
Nanocel. dosage 3 = 3000 g/tonne It can be observed that the nanocellulose acting like a microparticulate material gives faster dewatering than bentonite. This example shows clearly that the dewatering results with nanocellulose as a microparticle-like material are essentially better than when bentonite is used.

Example 3

Retention was also measured using a Retention Process Analyser (RPA) apparatus. The RPA looks like a DDJ but it also measures flocs and floc stability in the filtrate with turbidity measurements.

The stock used was stock taken from a fine-paper machine. The stock sample had been taken from the machine chest. The filler was added to the stock and the content of the filler in the stock was 45% of the dry solids content of the stock. The filler was precipitated calcium carbonate. For the tests the stock was diluted with white water to a consistency of 8.0 g/l. Starch was added into the stock before the drainage test started. The following, stepwise procedure was used in the tests:

1. The stock sample was poured into a vessel with mixing velocity being 1000 rpm, filtrate was passed through a wire and after that the turbidity measured. After this filtrate was added back to the vessel (circulation).
2. At 50 s, the polymer was dosed into the stock.
3. At 65 s, the microparticle or microparticle-like substance was dosage into the stock.
4. The stability of the flocs was measured until 120 s.

The wire used was a 200-mesh DDJ wire 125P. The polymer was a Kemira cationic polyacrylamide (PAM), which is a copolymer of acrylamide and acryloyloxyethyltrimethyl ammonium chloride and has a charge of approx. 1 meq/g and a molecular weight of approx. 7 Mg/mol. The bentonite microparticle used was Altonit SF of Kemira. The other component acting like a microparticle was the same nanocellulose as in example 1. The dosages are indicated as the amount of the material dosed as active substance per dry solids weight of the stock, the unit being g/tonne. The retention results are shown in Table 4.

TABLE 4

| | Relative retention value (%) by RPA | | | | | |
|---|---|---|---|---|---|---|
| | Bentonite dosage 1 | Bentonite dosage 2 | Bentonite dosage 3 | Nanocel. dosage 1 | Nanocel. dosage 2 | Nanocel. dosage 3 |
| 0-test | 0.96 | 0.96 | 0.96 | 0.96 | 0.96 | 0.96 |
| Polymer dosage | 62.8 | 74.2 | 90.4 | 70.6 | 78.6 | 87.1 |

Polymer dosage = 600 g/tonne
Bentonite dosage 1 = 500 g/tonne
Bentonite dosage 2 = 1500 g/tonne
Bentonite dosage 3 = 3000 g/tonne
Nanocel. dosage 1 = 500 g/tonne
Nanocel. dosage 2 = 1500 g/tonne
Nanocel. dosage 3 = 3000 g/tonne It can be observed that the nanocellulose acting like a microparticulate material gives as good relative retention value as bentonite. This means that same kinds of flocs are formed with nanocellulose as with bentonite.

The invention claimed is:

1. A process for the production of paper or board comprising:

adding components of a retention system comprising a water-soluble cationic polymer and nanocellulose acting like a microparticle, sequentially to a stream of stock entering a paper machine headbox, directing the stream of stock to a wire, dewatering the stream of stock on the wire to form a paper web, and drying the paper web, wherein the water-soluble cationic polymer is added to form flocs followed by subjecting the stock to shearing forces to break up the flocs and then adding the nanocellulose, and wherein the nanocellulose is added in an amount of less than 1% as active substance based on dry solids weight of the stock.

2. The process of claim 1, wherein the nanocellulose is added in an amount of between 0.02 and 0.8%, as active substance based on dry solids weight of the stock.

3. The process of claim 1 wherein the nanocellulose is added in the form of an aqueous suspension or gel comprising at most 5% by weight solids.

4. The process of claim 1, wherein the nanocellulose is produced from cellulose pulp by enzymatic treatment followed by homogenization in a high-pressure homogenizer.

5. The process of claim 1, wherein the nanocellulose is produced from cellulose pulp by chemical pre-treatment followed by homogenization in a high-pressure fluidizer.

6. The process of claim 1, wherein the time between the addition of the water-soluble cationic polymer and the nanocellulose is at most 60 seconds.

7. The process of claim 1, wherein the cationic polymer comprises a copolymer of acrylamide or methacrylamide and a cationic monomer.

8. The process of claim 1, wherein the molecular weight of the cationic polymer is at least 500,000.

9. The process of claim 1, wherein the cationic polymer is added in an amount of at least 0.02% as active substance based on dry solids weight of the stock.

10. The process of claim 1, wherein the stock contains chemical pulp, chemimechanical pulp, mechanical pulp or recycled fiber, or various combinations of these.

11. The process of claim 1, wherein the stock additionally comprises a filler and additives commonly used in the production of paper.

12. The process of claim 1, wherein the nanocellulose is added in an amount of between 0.05 and 0.7% as active substance based on dry solids weight of the stock.

13. The process of claim 1, wherein the nanocellulose is added in an amount of between 0.1 and 0.5% as active substance based on dry solids weight of the stock.

14. The process of claim 1, wherein the nanocellulose is added in the form of an aqueous suspension or gel comprising 0.1 to 4% by weight solids.

15. The process of claim 1, wherein the nanocellulose is added in the form of an aqueous suspension or gel comprising from 0.3 to 3% by weight solids.

16. The process of claim 4, wherein the enzyme in the enzymatic treatment comprises a cellulose.

17. The process of claim 16, wherein the cellulose is endoglucanase.

18. The process of claim 5, wherein the chemical pretreatment comprises carboxymethylation of the fibers.

19. The process of claim 1, wherein the time between the addition of the water-soluble cationic polymer and the nanocellulose is between 0.5 and 20 seconds.

20. The process of claim 1, wherein the cationic polymer is added in an amount of between 0.03 and 0.05% as active substance based on dry solids weight of the stock.

21. The process of claim 11, wherein the filler is ground or precipitated calcium carbonate, kaolin, calcined kaolin, talc, titanium dioxide, gypsum, or a synthetic inorganic or organic filler.

22. Use of nanocellulose as a material acting like a microparticle for improving the retention of papermaking raw materials during the production of paper or board, wherein the nanocellulose is used together with a retention aid comprising a water-soluble cationic polymer in such as manner that the nanocellulose is added after the water-soluble cationic polymer, and wherein the nanocellulose is used in an amount of less than 1% as active substance based on dry solids weight of the papermaking stock.

23. The use of claim 22, wherein the nanocellulose is used in an amount of between 0.02 and 0.8% as active substance based on dry solids weight of the stock.

24. The use of claim 22, wherein the nanocellulose is used in an amount of between 0.05 and 0.7% as active substance based on dry solids weight of the stock.

25. The use of claim 22, wherein the nanocellulose is used in an amount of between 0.1 and 0.5% as active substance based on dry solids weight of the stock.

* * * * *